US006581860B2

(12) United States Patent
Savolainen

(10) Patent No.: US 6,581,860 B2
(45) Date of Patent: Jun. 24, 2003

(54) CRUSHER

(75) Inventor: Reijo Savolainen, Siilinjärvi (FI)

(73) Assignee: Metso Minerals (Tampere) Oy, Tampere (FI)

( * ) Notice: Subject to any disclaimer, the term of this patent is extended or adjusted under 35 U.S.C. 154(b) by 0 days.

(21) Appl. No.: 09/998,005

(22) Filed: Nov. 29, 2001

(65) Prior Publication Data

US 2002/0074437 A1 Jun. 20, 2002

Related U.S. Application Data

(63) Continuation of application No. PCT/FI00/00541, filed on Jun. 15, 2000.

(30) Foreign Application Priority Data

Jun. 17, 1999 (FI) ..... 991388
Mar. 6, 2000 (FI) ..... 20000508

(51) Int. Cl.[7] ..... B02C 2/06
(52) U.S. Cl. ..... 241/101.3; 241/210; 241/215
(58) Field of Search ..... 241/101.3, 207–216

(56) References Cited

U.S. PATENT DOCUMENTS 5,718,391 A 2/1998 Musil
5,779,166 A 7/1998 Ruokonen et al.
6,213,418 B1 * 4/2001 Gabriel et al. ..... 241/207

FOREIGN PATENT DOCUMENTS

EP 0 408 204 B1 3/1994

* cited by examiner

*Primary Examiner*—Mark Rosenbaum
(74) *Attorney, Agent, or Firm*—Alston & Bird LLP

(57) ABSTRACT

A crusher comprises a main shaft a portion of which is disposed in a bore of a rotatable eccentric shaft, the main shaft (1) having a central axis that is inclined with respect to the axis of rotation of the eccentric shaft, and a first crushing head attached to the main shaft and rotatable by the main shaft with respect to a second crushing head so that constrained stroke motion is effected between the first crushing head and the second crushing head. The inclination of the central axis of the main shaft is changed with respect to the axis of rotation of the eccentric shaft by a gear transmission comprising cog wheels, such that the magnitude of the constrained stroke motion changes.

12 Claims, 10 Drawing Sheets

CRUSHER

CROSS-REFERENCE TO RELATED APPLICATION

This application is a continuation of International Application No. PCT/FI00/00541 filed Jun. 15, 2000, which was published in the English language.

FIELD OF THE INVENTION

The invention relates to a crusher comprising a main shaft, which is placed into a bore of a rotatable eccentric shaft, the main shaft having a central axis which is inclined with respect to the axis of rotation of the eccentric shaft, and a first crushing head, which is attached to the main shaft and rotatable by the main shaft with respect to a second crushing head so that constrained stroke motion is effected between the first crushing head and the second crushing head, whereby material can be crushed between the first crushing head and the second crushing head, whereby the eccentric shaft comprises an outer eccentric shaft with a second bore and an inner eccentric shaft, which is at least partly positioned so as to be continuously turnable with respect to the outer eccentric shaft in said second bore, whereby the bore is in the inner eccentric shaft, and whereby the inner eccentric shaft and the outer eccentric shaft are turnable with respect to each other by means of gear transmission so that the inclination of the central axis of the main shaft changes with respect to the axis of rotation of the eccentric shaft such that the length of the constrained stroke motion changes.

BACKGROUND OF THE INVENTION

An arrangement for adjusting the value of constrained pendulous motion or stroke of a crusher is previously known, in which an eccentric shaft is carried by an eccentric bearing having a wedge groove on the outer surface of the eccentric bearing. The eccentric bearing is held in place by means of a corresponding safety wedge so that the bearing cannot rotate during the rotating motion of the eccentric shaft. By turning the eccentric bearing, the stroke can be adjusted. In this crusher, the stroke is adjusted stepwise.

Another known method for adjusting stroke of a crusher having an eccentric bearing is to replace the entire eccentric bearing with a different kind of eccentric bearing providing a different stroke.

In the aforementioned arrangements, the stroke adjustment always requires dismantling of the crusher.

A solution to this problem is described in U.S. Pat. No. 5,718,391. This publication discloses a stroke adjusting apparatus, wherein an outer eccentric shaft comprises a worm shaft turnable by means of a hydraulic motor, the worm shaft being arranged to co-operate with toothing on the outer surface of the inner eccentric shaft such that the inner eccentric shaft can be turned in the outer eccentric shaft. This arrangement thus allows the stroke adjustment to be made without having to dismantle the crusher. A disadvantage of this solution is, however, that the worm gear and hydraulic motor required for turning the eccentric shafts with respect to each other are machine elements that require a lot of space. Thus, the eccentric shaft and thereby the crusher frame have to be sized much bigger than would otherwise be necessary. Accordingly, the total weight of the crusher and its manufacturing costs increase considerably.

Furthermore, the crusher disclosed in U.S. Pat. No. 5,718,391 has the problem that the hydraulic fluid required for effecting the stroke adjustment of the crusher has to be distributed through the outer eccentric shaft in rotating motion to the hydraulic motor while the crusher is in operation. Under dusty conditions of a crushing plant it is very difficult to make this kind of arrangement such that it does not leak.

SUMMARY OF THE INVENTION

The invention relates to a crusher which solves the problems described above. The crusher according to the invention is characterized in that the gear transmission comprises a first cog wheel attached to the inner eccentric shaft, a second cog wheel attached to the outer eccentric shaft, and a turning mechanism for turning the first cog wheel and the second cog wheel with respect to each other such that the inner eccentric shaft and the outer eccentric shaft turn with respect to each other.

Thus, the internal stroke adjustment arrangement of the crusher is entirely mechanical in the solution according to the invention.

The preferred embodiments of the crusher according to the invention are disclosed in the dependent claims.

The invention is based on the eccentric shaft comprising two parts, the outer eccentric shaft and the inner eccentric shaft inside it. The first cog wheel is attached to the inner eccentric shaft and the second cog wheel is attached to the outer eccentric shaft. By turning the first cog wheel and the second cog wheel with respect to each other by means of the turning mechanism, the inner eccentric shaft and the outer eccentric shaft turn with respect to each other.

With this arrangement the inclination of the central axis of the main shaft can be changed with respect to the axis of rotation of the eccentric shaft such that the value of the constrained pendulous motion, i.e., the stroke, changes.

The crusher according to the invention provides the advantage that the stroke can be adjusted without dismantling the crusher. The arrangement according to the invention also enables a continuous stroke adjustment within a range of 0 to 40 mm, for example.

BRIEF DESCRIPTION OF THE DRAWINGS

The invention will now be described in greater detail in connection with the preferred embodiments, with reference to the attached drawings, in which FIG. 1 schematically shows a sectional side view of a gyratory crusher, the gyratory crusher comprising a hydraulic adjustment apparatus for narrowing a gap between a first and a second crushing head, FIG. 2 schematically shows a sectional side view of a gyratory crusher having a different kind of hydraulic adjustment apparatus than the gyratory crusher shown in FIG. 1, FIG. 3 schematically shows a sectional side view of a cone crusher, FIG. 4 schematically shows a sectional side view of a cone crusher having a turning arrangement for turning an outer eccentric shaft with respect to an inner eccentric shaft, FIG. 5 schematically shows a top view of a detail of the gyratory crusher of FIGS. 1 to 3, FIG. 6 schematically shows a sectional side view of the gyratory crusher detail of FIG. 5, FIG. 7 schematically shows a top view of a detail of the gyratory crusher of FIG. 4, FIG. 8 schematically shows a sectional side view of the gyratory crusher detail of FIG. 7, and FIGS. 9 to 16 show various solutions to adjust constrained stroke motion.

DETAILED DESCRIPTION OF PREFERRED EMBODIMENTS

Figure 1:
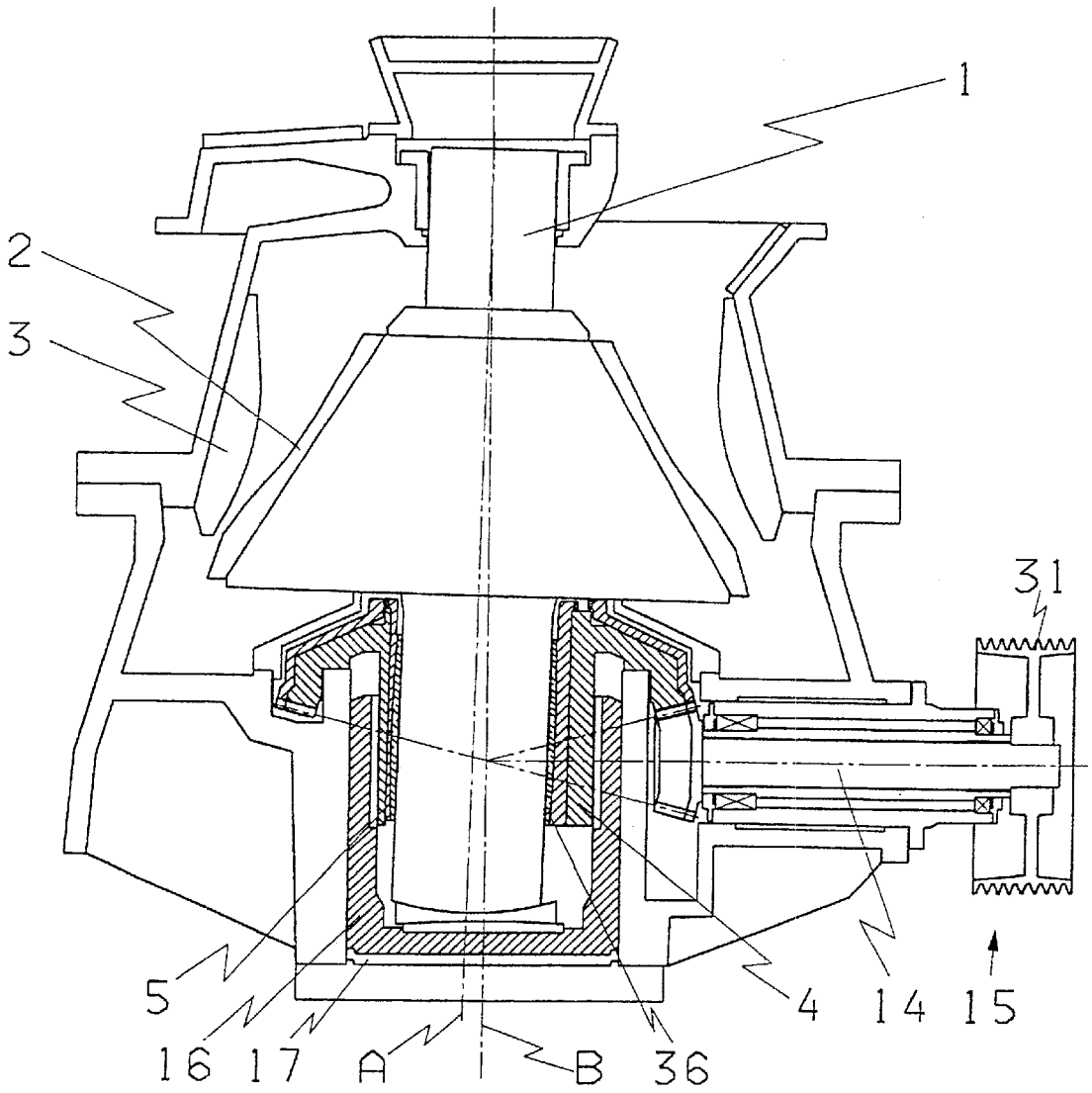
Figure 2:
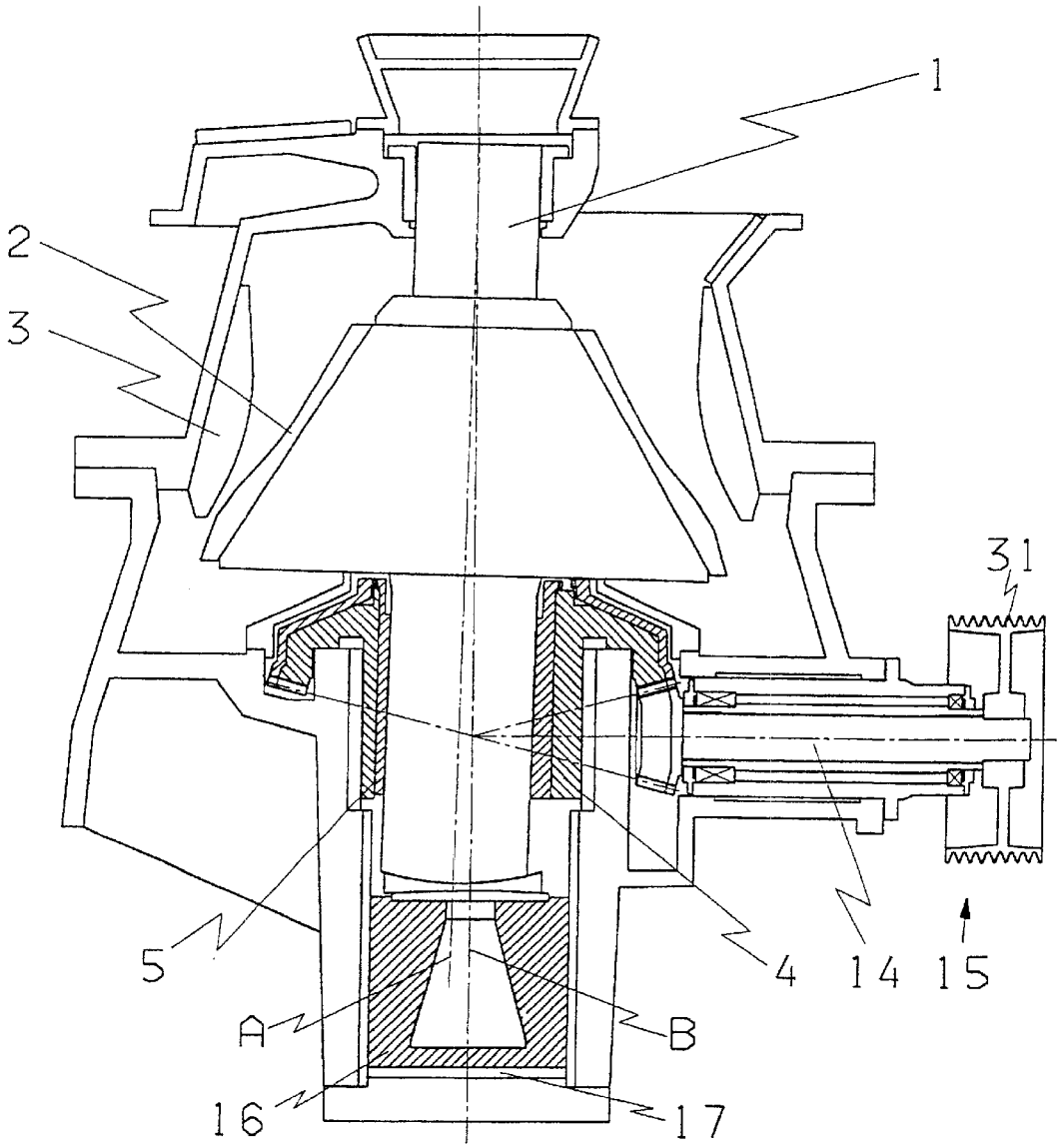
Figure 3:
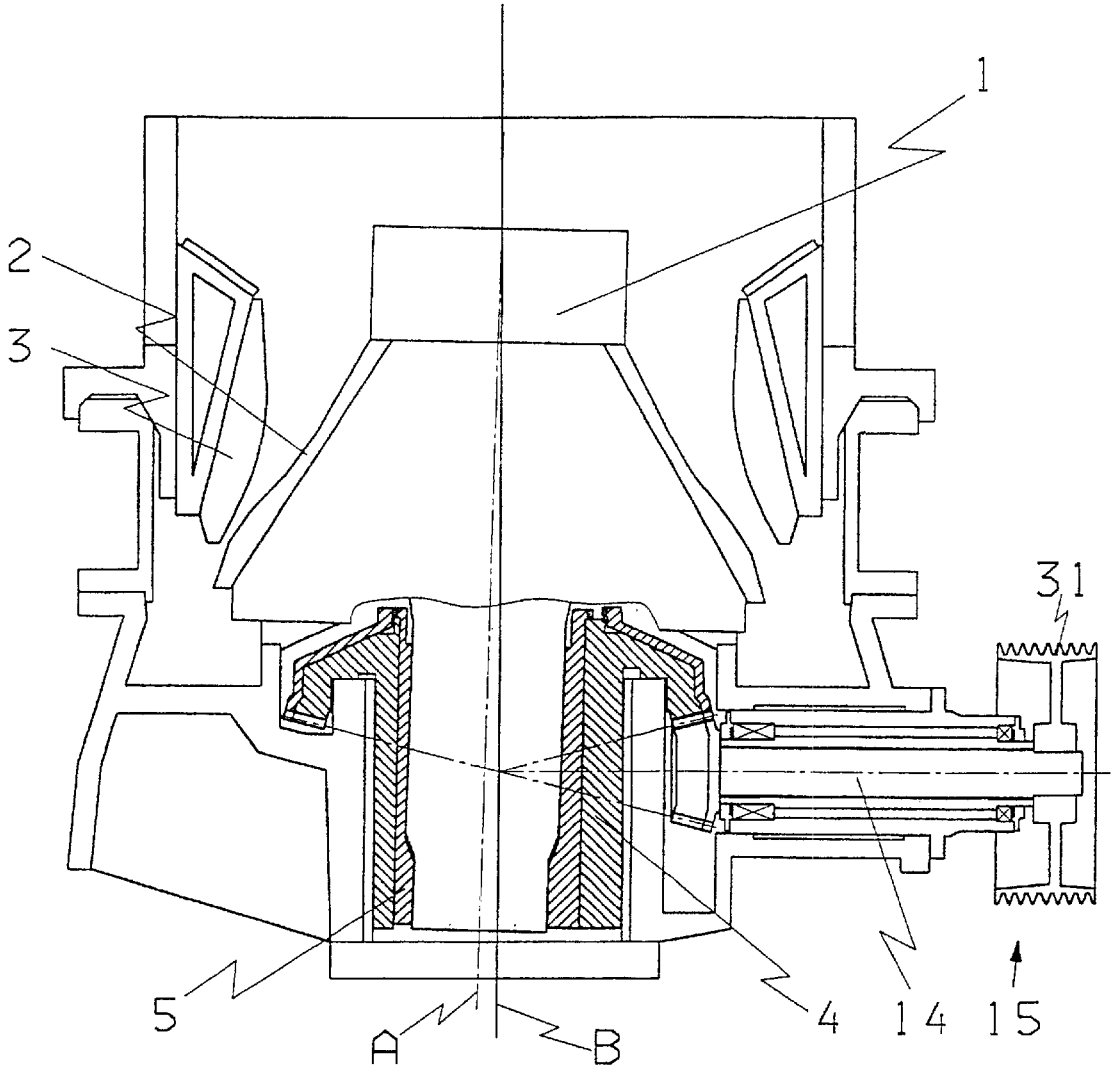
Figure 4:
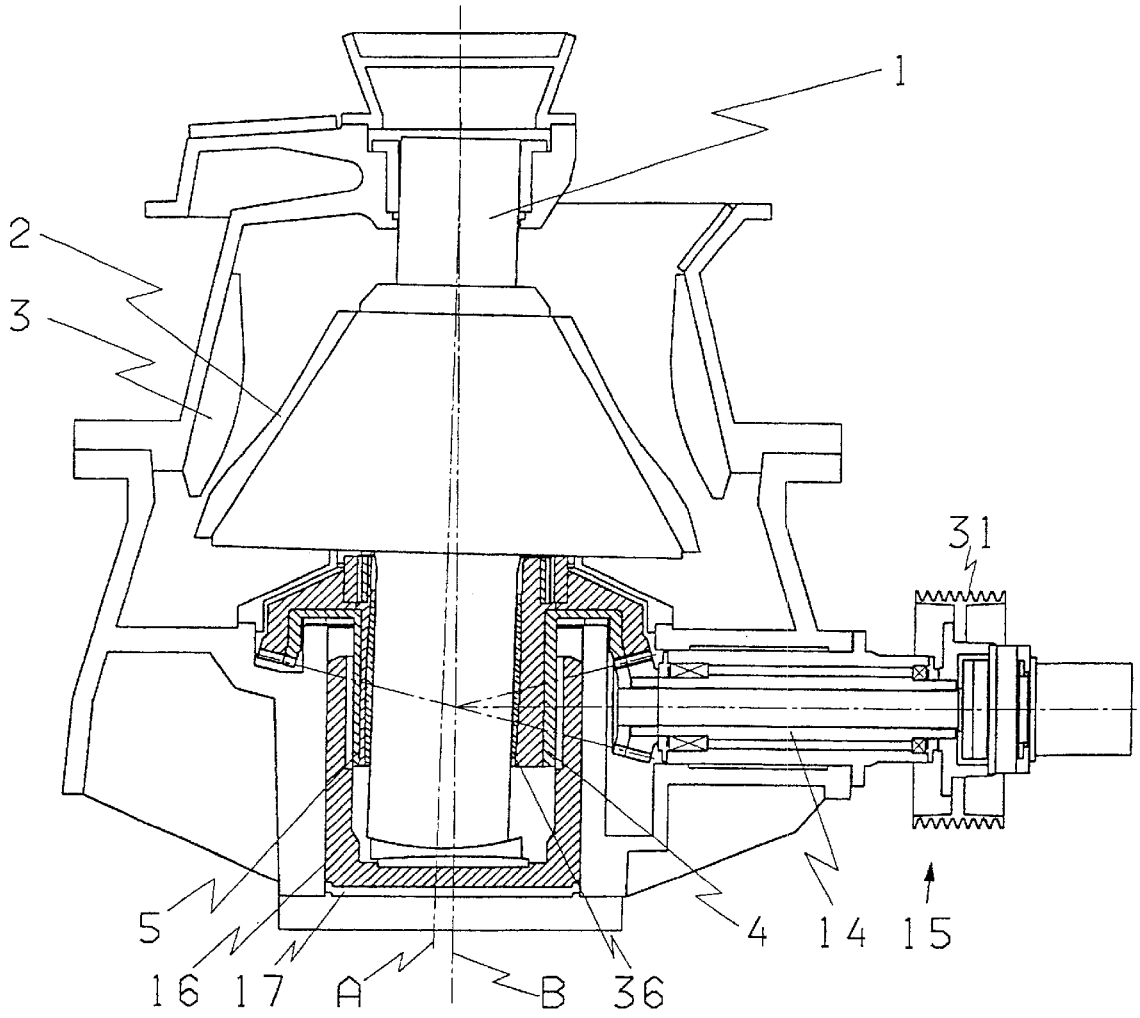

FIGS. 1, 2 and 4 show a gyratory crusher with a main shaft 1, which is placed into a bore 18 of a rotatable eccentric shaft (not marked with a reference number), the bore preferably being an inclined bore. In like manner, FIG. 3 shows a cone crusher.

The main shaft 1 has a central axis A, which is inclined with respect to the axis of rotation of the eccentric shaft. Since the main shaft 1 is in the bore 18 of said eccentric shaft, the main shaft 1 and its central axis A are inclined with respect to the axis of rotation B of the eccentric shaft.

The crusher comprises a first crushing head 2, which is attached to the main shaft 1 and rotatable by the main shaft 1 with respect to a second crushing head 3 so that constrained pendulous motion, or stroke motion, is effected between the first crushing head 2 and the second crushing head 3. During a working cycle the bore 18 of the eccentric shaft effects said constrained pendulous motion of the first crushing head 2, which constrained pendulous motion narrows and enlarges the gap (not marked with a reference number) between the first crushing head 2 and the second crushing head 3 and effects the crushing of the material (not shown) to be crushed.

The first crushing head 2 and the second crushing head 3 in FIGS. 1 to 4 are mainly cone-shaped crushing heads.

The eccentric shaft comprises an outer eccentric shaft 4 with a second bore (not marked with a reference number) and an inner eccentric shaft 5 which is at least partly positioned so as to be continuously turnable in said second bore. The bore 18, in which the eccentric shaft at least partly is, is in the inner eccentric shaft 5.

By turning the inner eccentric shaft 5 and the outer eccentric shaft 4 with respect to each other, the inclination of the central axis A of the main shaft 1 can be changed with respect to the axis of rotation B of the eccentric shaft such that the value of said constrained pendulous motion changes. This is because the relative position of the central axis of the bore 18 and the axes of rotation B of the eccentric shaft 1 change. If the central axis of the bore 18 is on the axis of rotation B of the eccentric shaft, the central axis A of the main shaft 1 is at the same location as the axis of rotation B of the eccentric shaft, wherefore there occurs no stroke motion. If the central axis of the bore 18 is taken farther off from the axis of rotation B of the eccentric shaft, the stroke becomes longer. Simultaneously the inclination of the central axis A changes with respect to the axis of rotation B of the eccentric shaft.

The adjustment of constrained stroke motion can for example be implemented such that while the inner eccentric shaft 5 moves half a circle with respect to the outer eccentric shaft 4, the inclination of the central axis A of the main shaft 1 changes with respect to the axis of rotation B of the eccentric shaft from the maximum to the minimum. In this case the stroke change can equal to 0 to 40 mm, for example.

The crusher further comprises gear transmission (not marked with a reference number) to turn the inner eccentric shaft 5 and the outer eccentric shaft 4 with respect to each other such that the inclination of the central axis A of the main shaft 1 changes with respect to the axis of rotation B of the eccentric shaft, as a result of which the value of the constrained stroke motion changes. This gear transmission is preferably also arranged to keep the inner eccentric shaft 5 in a non-rotating manner in place with respect to the outer eccentric shaft 4.

The gear transmission comprises a first cog wheel 6 attached to the inner eccentric shaft 5 and a second cog wheel 11 attached to the outer eccentric shaft 4. The gear transmission further comprises a turning mechanism (not marked with a reference number) for turning the first cog wheel 6 and the second cog wheel 11 with respect to each other such that the inner eccentric shaft 5 and the outer eccentric shaft 4 turn with respect to each other. It is also possible that the first cog wheel 6 is a gear ring (not shown) which does not entirely surround the inner eccentric shaft 5 and/or the second cog wheel 11 is a gear ring (not shown) which does not entirely surround the outer eccentric shaft 4.

Figure 5:
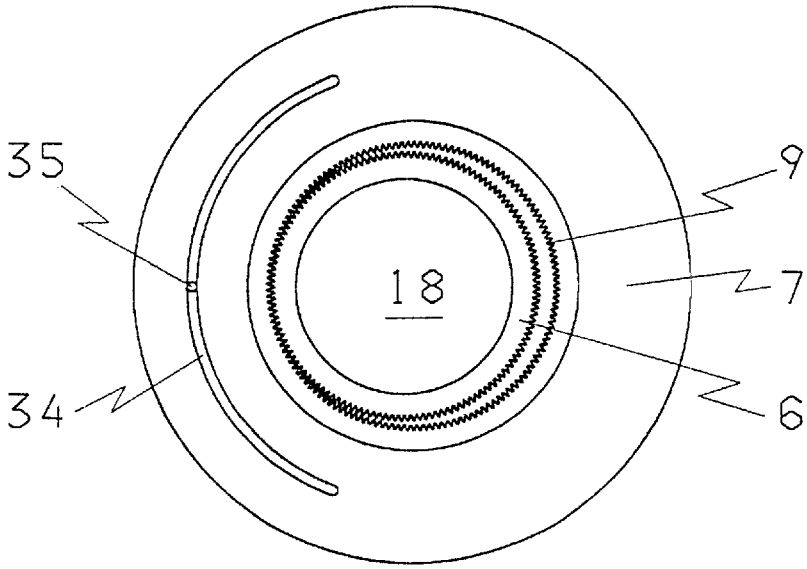
Figure 6:
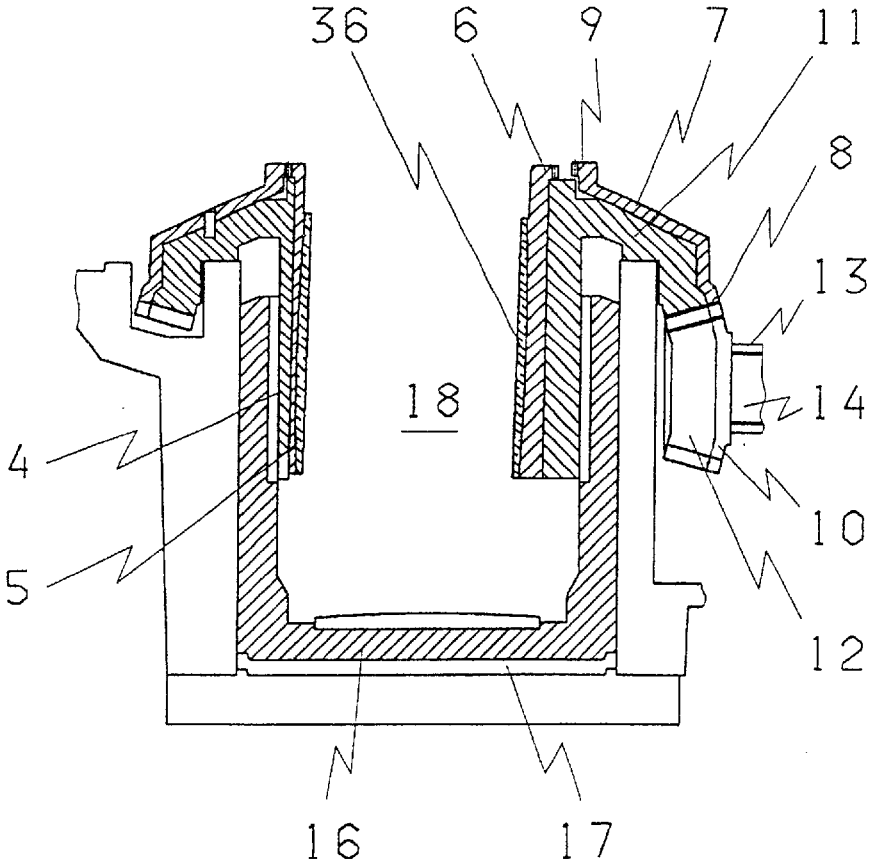

In a first preferred embodiment according to the invention, which is shown in FIGS. 1 to 3, for example, and a detail of which is shown enlarged in FIGS. 5 and 6, said turning mechanism comprises a third cog wheel 7 with external toothing 8 and internal toothing 9. The internal toothing 9 of the third cog wheel 7 is arranged to co-operate with the first cog wheel 6. There is also a control cog wheel 10, which is arranged to co-operate with the external toothing 8 of the third cog wheel 7. The inner eccentric shaft 5 can thus be turned in said second bore of the outer eccentric shaft 4 by turning the control cog wheel 10 in another direction and/or with another speed than the drive gear 12.

Alternatively the turning mechanism can consist of the external toothing 8 in the third cog wheel 7, for example, the external toothing cooperating with a worm shaft (not shown). There are also other possibilities, the third cog wheel 7 can for example be turned by means of a motor (not shown) in connection with it, which for example directly affects the external gear 8 of the third cog wheel 7. The third cog wheel 7 can also be turned by means of a hydraulic system (not shown).

Figure 7:
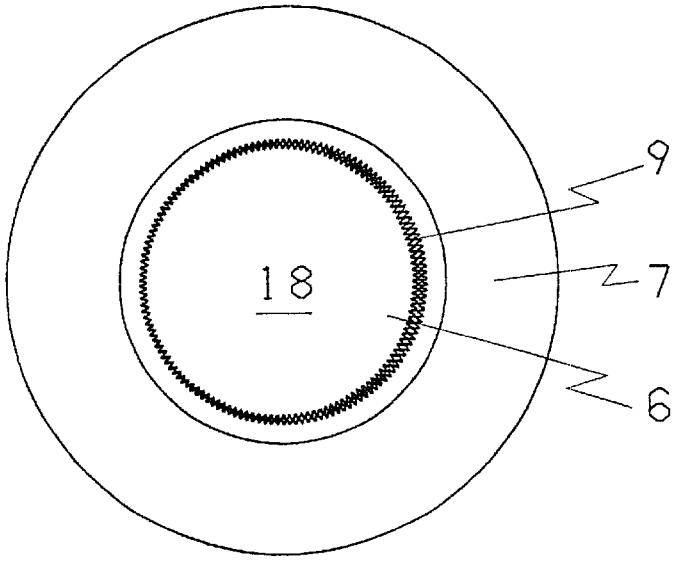
Figure 8:
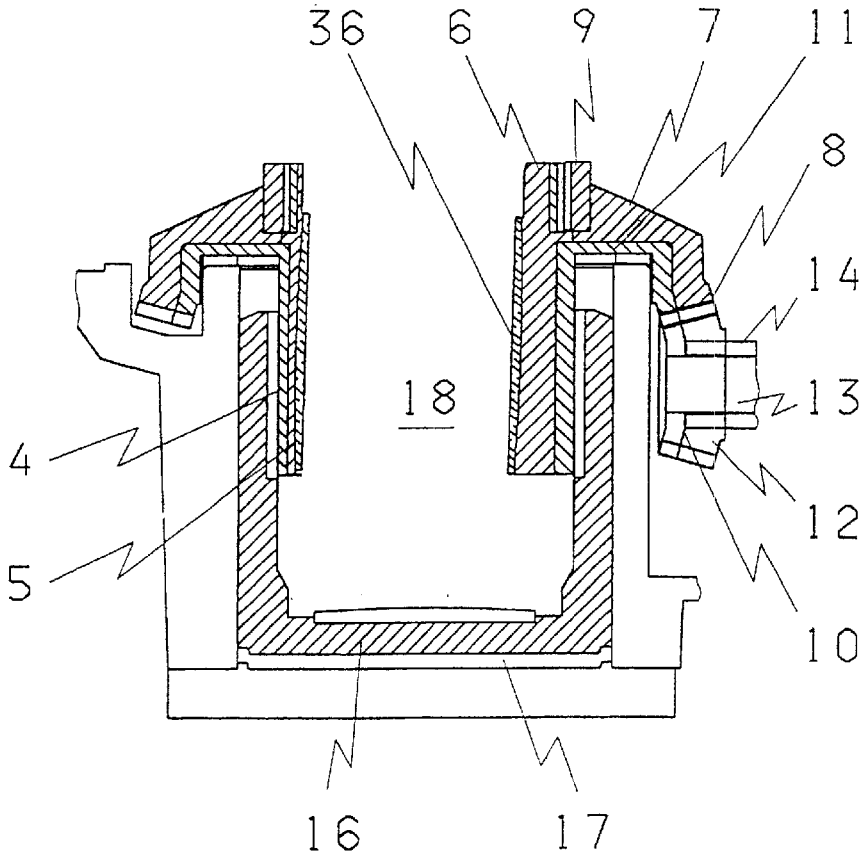

In a second embodiment of the solution according to the invention, which is shown for example in FIG. 4 and a detail of which is shown enlarged in FIGS. 7 and 8, said turning mechanism comprises a control cog wheel 10 arranged to co-operate with the second cog wheel 11 attached to the outer eccentric shaft 4. The turning mechanism of FIGS. 7 and 8 also comprises the third cog wheel 7 with the external toothing 8 and the internal toothing 9 which is arranged to co-operate with the first cog wheel 6. Thus, the outer eccentric shaft 4 can be turned with respect to the inner eccentric shaft 5 by turning the control cog wheel 10 in another direction and/or with another speed than the drive gear 12.

In the solutions according to the figures, the control cog wheel 10 is preferably mounted on a control shaft 13.

By using the third cog wheel 7 by means of the drive gear 12 and the second cog wheel 11 by means of the control cog wheel 10 in the same direction and substantially at the same speed, the eccentric shaft consisting of the inner eccentric shaft 5 and the outer eccentric shaft 4 is made to rotate by means of operating means (not shown) in the solution according to FIGS. 6 and 8, such that said constrained pendulous motion is effected between the first crushing head 2 and the second crushing head 3.

In the figures the control cog wheel 10 and the drive gear 12 are positioned substantially concentrically.

For example, in the solution shown in FIG. 6, which relates to FIGS. 1 to 3, the control cog wheel 10 is mounted on the control shaft 13, which is hollow. The drive gear 12 is mounted on a drive shaft 14, which is in the control shaft 13. The control shaft 13 and the drive shaft 14 are substantially coaxial.

FIG. 8 shows a solution which relates to FIG. 4. In the solution according to FIG. 8 the drive gear 12 is mounted on a drive shaft 14, which is hollow. The control cog wheel 10 is correspondingly mounted on the control shaft 13, which is in the drive shaft 14. The control shaft 13 and the drive shaft 14 are substantially coaxial.

In the figures, a drive belt pulley 31 is mounted on the drive shaft 14. Alternatively the drive shaft can be rotated in some other way.

In the solution shown in the figures, the control cog wheel 10 and the third cog wheel 7 form a bevel gear pair. The second cog wheel 11 and the drive gear 12 also form a bevel gear pair in the figures.

Preferably the crusher also comprises a control unit 15 by which the reciprocal ratio of rotation and/or rotational speed of the control cog wheel 10 and the drive gear 12 or those of the control shaft 13 and the drive shaft 14 can be changed such that the stroke changes.

The crusher preferably comprises an element for limiting the maximum rotational angle (not marked with a reference number) which is adapted to limit the maximum rotational angle between the inner eccentric shaft 5 and the outer eccentric shaft 4. In the crusher shown in FIG. 5, the third cog wheel 7 comprises a groove 34, in which there is a stop pin 35, which is attached to the second cog wheel 11 attached to the outer eccentric shaft 4 and which prevents the reciprocal motion, i.e. rotation, of the inner eccentric shaft 5 and the outer eccentric shaft 4, if necessary. In FIG. 5, the groove 34 and the stop pin 35 form the element for limiting the maximum rotational angle. The groove 34 can alternatively be formed for example in the inner eccentric shaft 5, the outer eccentric shaft 4 or the second cog wheel 11, in which groove the stop pin 35 attached to the outer eccentric shaft 4, the inner eccentric shaft 5 or the third cog wheel 7 correspondingly moves.

In the crusher according to FIGS. 1 and 4, there is a bearing 36, which may for example be cylindrical or spherical (as in the figure), between the inner eccentric shaft 5 and the main shaft 1. A spherical bearing allows the main shaft 1 to be properly positioned.

FIGS. 9 to 16 show various control unit solutions 15. The solutions shown in FIGS. 9 to 14 and 16 are such that the reciprocal ratio of rotation of the control cog wheel 10 and the drive gear 12 can be adjusted either when the crusher is in operation (with and/or without a load) or when it is at a standstill. The adjustment with the solution shown in FIG. 15 requires that the crusher is at a standstill.

Figure 9:
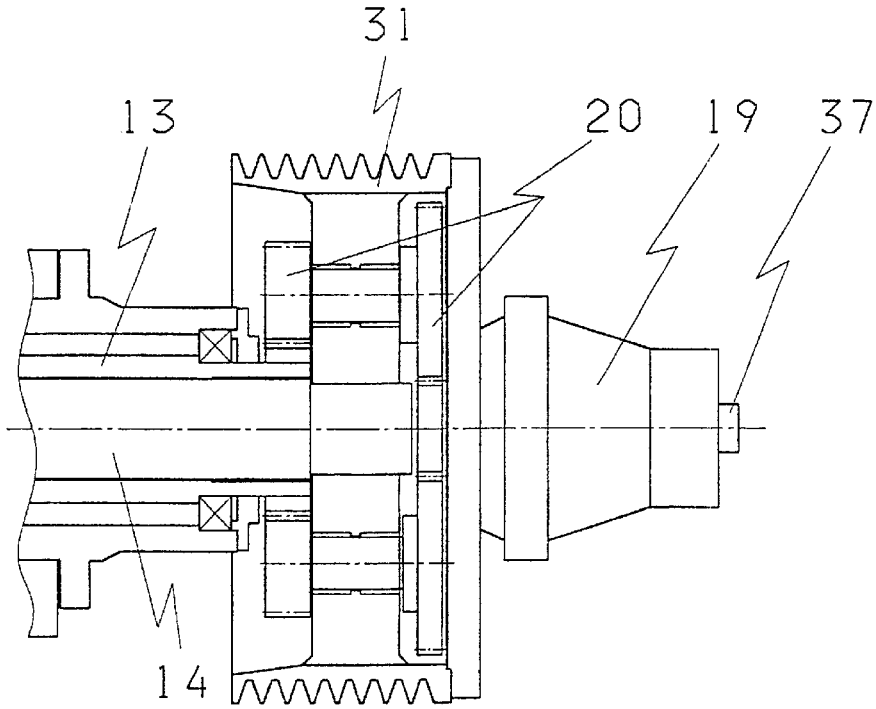

In a control unit solution according to FIG. 9, operating means 19, e.g. a hydraulic or an electric motor, using cog wheels or chains rotating the control shaft either directly or, as in FIG. 9, by means of a planetary gear 20, are attached to a drive belt pulley 31. The operating means 19 are preferably provided with either an integrated or external brake (not shown), the purpose of which is to prevent the control shaft 13 from unintentionally rotating with respect to the drive shaft 14.

Figure 10:
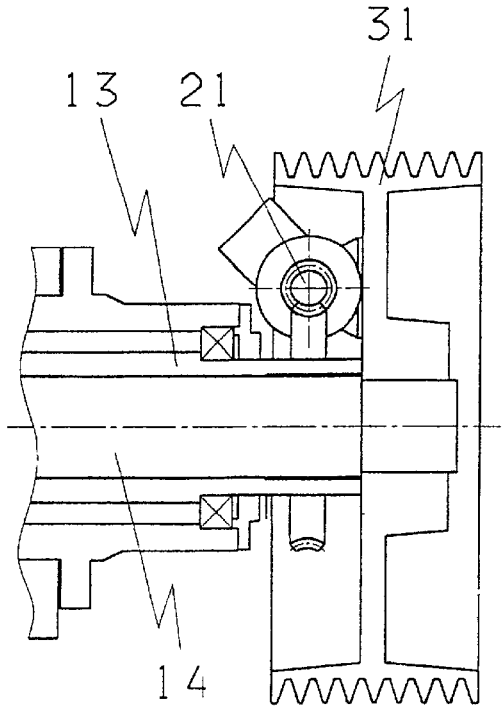

In a control unit solution shown in FIG. 10, worm gear transmission 21, which is arranged to co-operate with the control shaft 13 such that the control shaft can be turned by means of the worm gear transmission 21, is attached to the drive belt pulley. In the worm gear transmission 21 according to FIG. 10 there is a worm (not marked with a reference number) which is used by operating means (not marked with a reference number), preferably by a small electric or hydraulic motor. The control shaft 13 can be rotated simultaneously by several this kind of worm gear transmissions 21.

Figure 11:
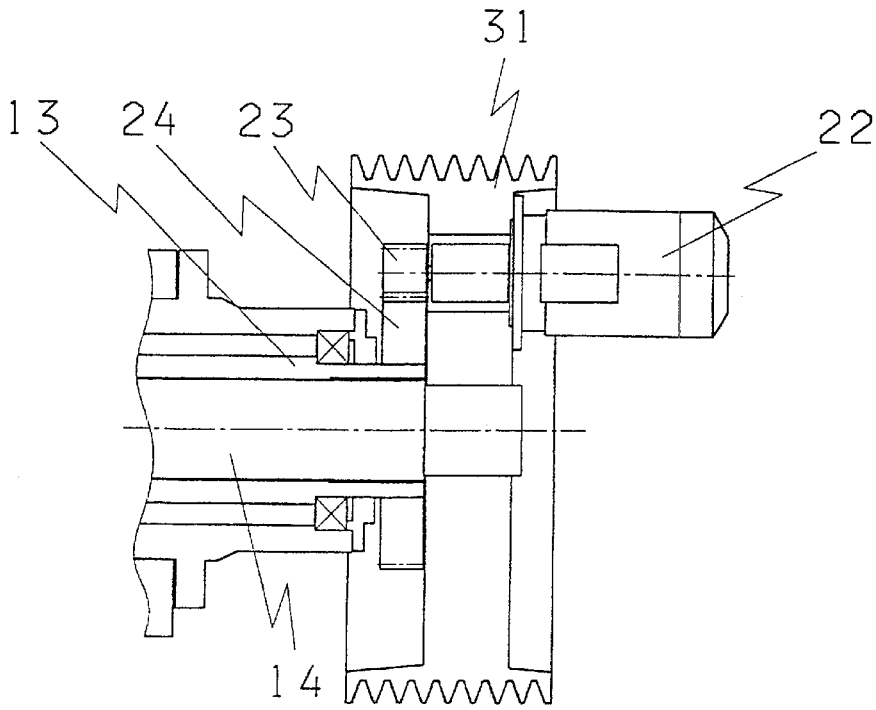

In a control unit solution shown in FIG. 11, operating means 22, which are preferably a small electric or hydraulic motor, adapted to co-operate with a cog wheel 23, are attached to the drive belt pulley. The cog wheel 23 in turn is arranged to co-operate with a second cog wheel 24 mounted on the control shaft 13 such that the control shaft 13 can be turned by means of the operating means 22.

Figure 12:
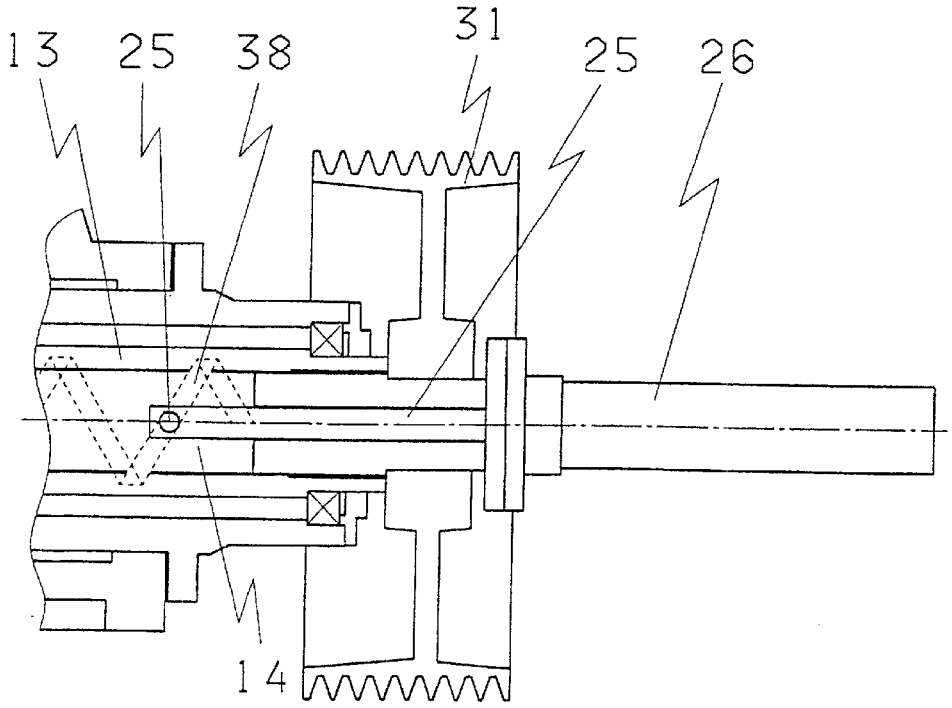

A control solution shown in FIG. 12 differs from the above described in such a manner that control power that is supplied from outside the crusher and that rotates a control shaft 13 is linear. Therefore, an internal spiral grooving 38 is made on the control shaft 13. When a control rod 25 is pulled and pushed in a groove (not marked with a reference number) of the drive shaft 14, a slide 27 attached to the control rod slides in the spiral groove 38 of the control shaft 13 and thereby forces the control shaft 13 to rotate. Control power can be generated for example by means of a hydraulic or pneumatic cylinder 26, which rotates along with the control shaft 13.

Figure 13:
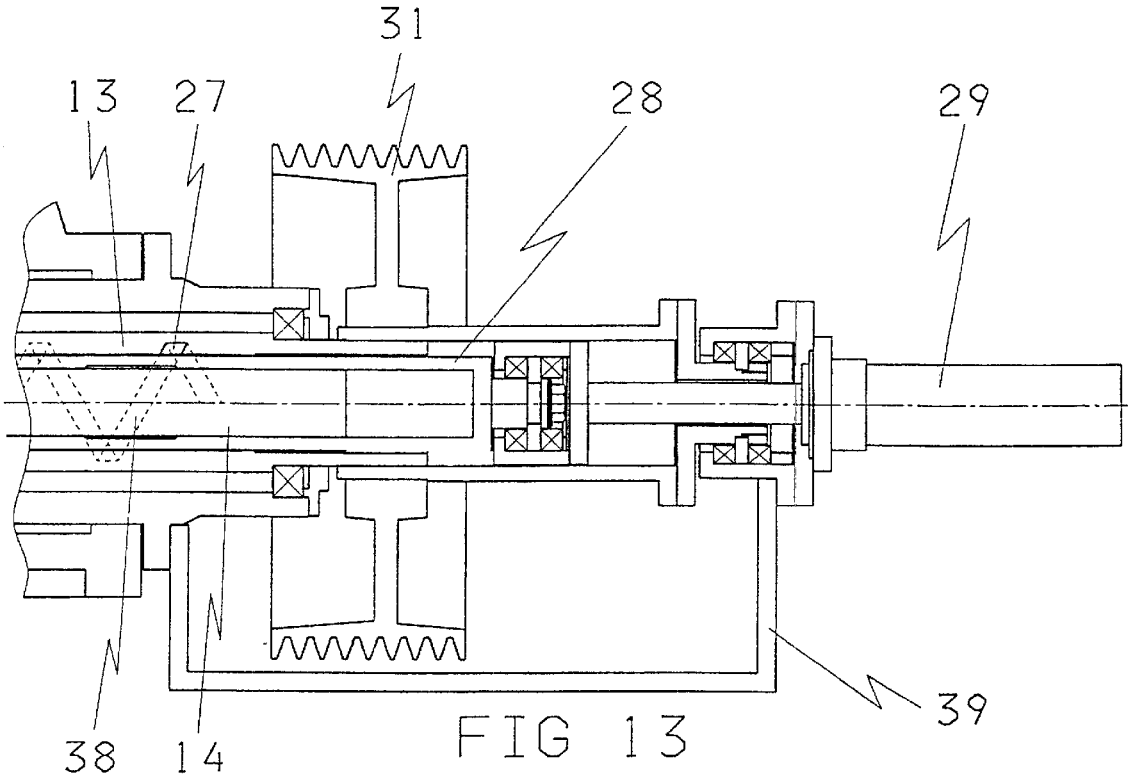

In a control solution shown in FIG. 13, control power that is supplied from outside the crusher and that rotates a control shaft 13 is also linear. For this purpose, an internal spiral grooving 38 is made on the control shaft 13 according to the figure. When a control rod 28 is pulled and pushed, a slide 27 attached to the control sleeve slides in the spiral groove 38 of the control shaft 13 and thereby forces the control shaft 13 to rotate. Control power can be generated for example by means of a hydraulic or pneumatic cylinder 29, which is pivoted to the control sleeve 28 and a drive belt pulley 31 and which is attached to the crusher frame by means of a fastening element 39 such that the cylinder 29 does not rotate while the crusher is in operation.

Figure 14:
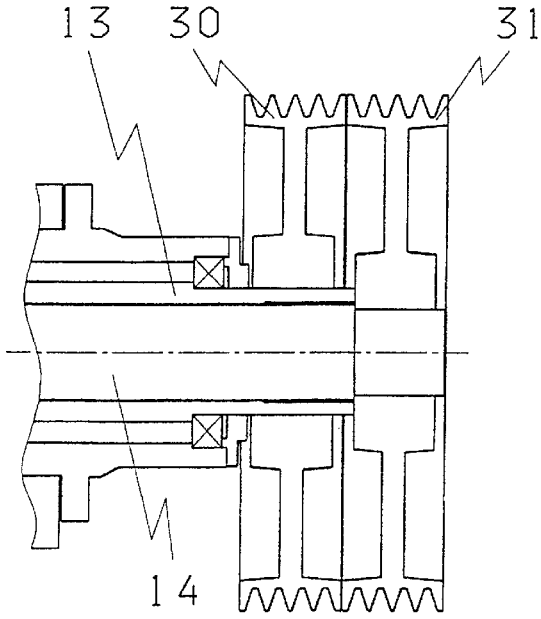

In a control unit solution shown in FIG. 14, a control shaft 13 is turned by means of a separate drive belt pulley 30 which can be synchronized with a drive belt pulley 31 of a drive shaft 14. These drive belt pulleys 30 and 31 can either be on the same or on a different axis. The reciprocal speed of the drive shaft 14 and the control shaft 13 (the stroke of the crusher) is changed by rotating the above mentioned drive belt pulleys 30 and 31 at a speed differing from each other. The speed of the drive belt pulleys 30 and 31 can be synchronized to be the same, when the stroke is not changed.

Figure 15:
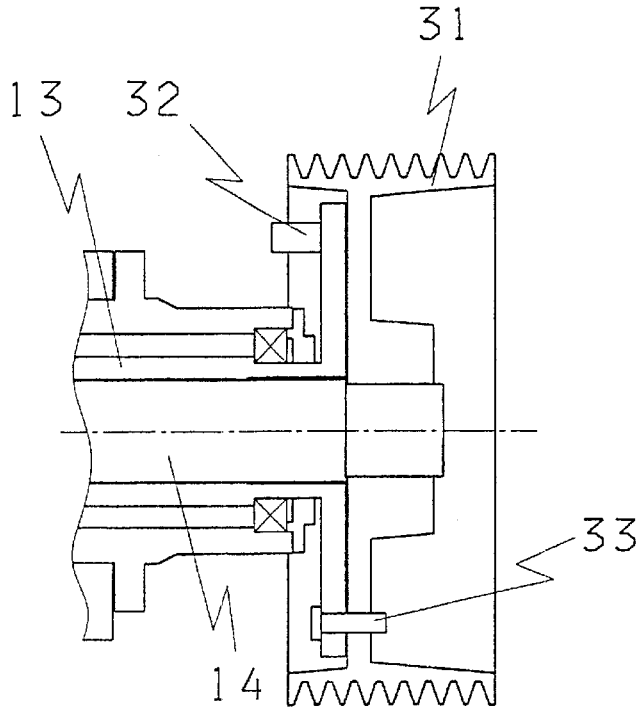

In a control unit solution shown in FIG. 15 a cog wheel 10 is turned when the crusher is at a standstill. In the solution according to this figure, a control shaft is rotated manually or by means of a handle 32 and it is locked in its place for example by means of pins 33 to be mounted in different bores. Instead of the pin 33, the solution according to FIG. 15 may comprise a brake mechanism or the like (not shown in the figures) which locks a drive shaft 14 and the control shaft 13 with respect to each other.

Figure 16:
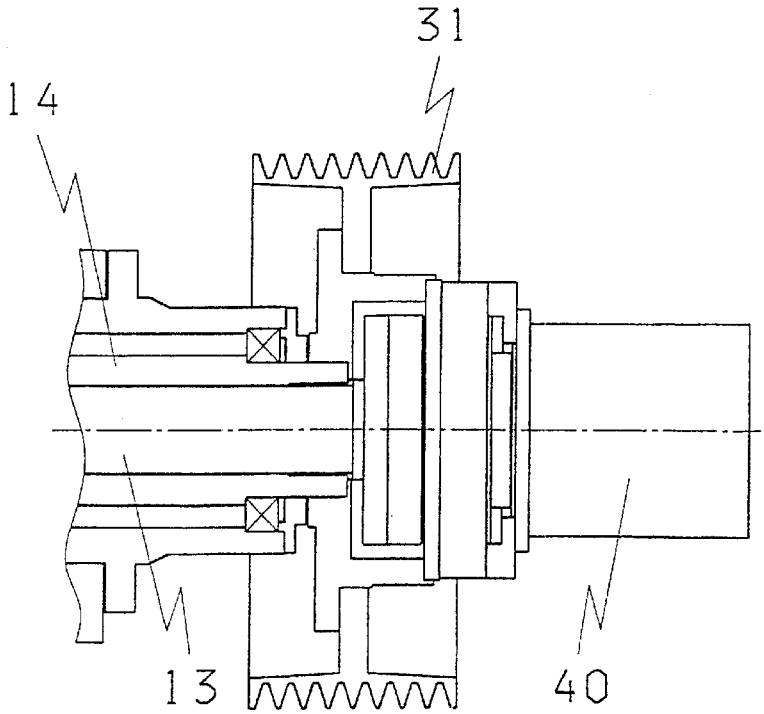

FIG. 16 shows a control solution of the crusher according to FIG. 4. In this solution a control shaft 13 is placed inside a hollow drive shaft 14. The control shaft is rotated with respect to the drive shaft by means of a motor 40 placed at the end of the control shaft by means of a gear, the motor being able to rotate along with the drive shaft when the crusher is in operation. A brake motor which locks to be non-rotating when no energy is fed thereto is the most suitable for the purpose. Thus no separate locking mechanism is required between the control shaft 13 and the drive shaft 14 to prevent their reciprocal motion.

The crusher according to FIG. 9 is preferably provided with a rotational angle indicator 37, e.g. a stepping motor. This rotational angle indicator 37 is adapted to directly measure the rotational angle between the inner eccentric shaft 5 and the outer eccentric shaft 4 or to monitor the relative position of the elements controlling the rotational angle between the inner eccentric shaft 5 and the outer eccentric shaft 4, i.e. the relative position of the turning mechanism or gear transmission parts.

The crusher shown in FIG. 1 further comprises a hydraulic adjustment apparatus for changing the lowest value of the gap between the first crushing head 2 and the second crushing head 3, i.e. for adjusting the crusher. The adjustment is changed by means of a hydraulic adjustment apparatus by supplying a pressurized medium to a space 17 below a control piston 16, whereby the first crushing head 2 rises and thereby reduces the adjustment. Correspondingly, by removing pressurized medium from the space 17, the first crushing head 2 moves down and the adjustment enlarges. The piston has an open-top cylinder shape. The lower end of the main shaft 1 rests against the bottom of the cylinder on a bearing element. Such a hydraulic control apparatus is described in the publication EP 0 408 204 B1, for example.

The gyratory crusher shown in FIG. 2 comprises a different kind of hydraulic control apparatus for changing the lowest value of the gap between the first crushing head 2 and the second crushing head 3, i.e. to adjust the crusher. In the crusher according to FIG. 2, a control piston 16 is entirely below the main shaft 1.

It is obvious to a person skilled in the art that as technology develops, the basic idea of the invention can be implemented in various ways. The invention and its embodiments are thus not restricted to the above described examples but may vary within the scope of the claims.

What is claimed is:

1. A crusher comprising:

a rotatable eccentric shaft having an axis of rotation, a main shaft having a portion thereof disposed in a bore in the rotatable eccentric shaft, the main shaft having a central axis which is inclined with respect to the axis of rotation of the eccentric shaft, a first crushing head attached to the main shaft and rotatable by the main shaft with respect to a second crushing head so that constrained stroke motion is effected between the first crushing head and the second crushing head such that material can be crushed between the first crushing head and the second crushing head, wherein the eccentric shaft comprises an inner eccentric shaft in which the bore is defined and an outer eccentric shaft surrounding the inner eccentric shaft, the inner and outer eccentric shafts being structured and arranged to be continuously rotatable with respect to each other through at least part of a 360-degree revolution, and a gear transmission for rotating the inner eccentric shaft and the outer eccentric shaft with respect to each other so as to cause the inclination of the central axis of the main shaft to change with respect to the axis of rotation of the eccentric shaft such that a length of the constrained stroke motion is changed, wherein the gear transmission comprises:

a first cog wheel attached to the inner eccentric shaft, a second cog wheel attached to the outer eccentric shaft, and a turning mechanism for turning the first cog wheel and the second cog wheel with respect to each other such that the inner eccentric shaft and the outer eccentric shaft turn with respect to each other.

2. A crusher as claimed in claim 1, wherein the turning mechanism comprises a third cog wheel with external toothing and having internal toothing arranged to co-operate with the first cog wheel, and a control cog wheel arranged to co-operate with the external toothing of the third cog wheel, such that the inner eccentric shaft is rotatable in the outer eccentric shaft by turning the control cog wheel.

3. A crusher as claimed in claim 2, further comprising a drive gear for driving the second cog wheel, and a control unit operable to change a reciprocal ratio of rotation of the control cog wheel and the drive gear so as to change the length of the constrained stroke motion.

4. A crusher as claimed in claim 2, wherein the control cog wheel is mounted on a hollow control shaft, and further comprising a drive gear arranged to co-operate with the second cog wheel and which drive gear is mounted on a drive shaft which is at least partly disposed in the control shaft, and wherein the control shaft and the drive shaft are substantially coaxial.

5. A crusher as claimed in claim 4, further comprising a locking device for locking the control shaft with respect to the drive shaft.

6. A crusher as claimed in claim 1, wherein the turning mechanism comprises a control cog wheel arranged to co-operate with the second cog wheel, and a third cog wheel with external toothing and having internal toothing arranged to co-operate with the first cog wheel, such that the outer eccentric shaft can be turned with respect to the inner eccentric shaft by turning the control cog wheel.

7. A crusher as claimed in claim 6, further comprising a drive gear for driving the third cog wheel, and a control unit operable to change a reciprocal ratio of rotation of the control cog wheel and the drive gear.

8. A crusher as claimed in claim 6, further comprising a drive gear arranged to co-operate with the third cog wheel and which drive gear is mounted on a hollow drive shaft, and wherein the control cog wheel is mounted on the control shaft, which is at least partly disposed in the hollow drive shaft, and the control shaft and the drive shaft are substantially coaxial.

9. A crusher as claimed in claim 8, further comprising a locking device for locking the control shaft with respect to the drive shaft.

10. A crusher as claimed in claim 1, wherein there is a bearing between the inner eccentric shaft and the main shaft.

11. A crusher as claimed in claim 1, further comprising an element for limiting relative rotation between the inner eccentric shaft and the outer eccentric shaft to a maximum rotational angle.

12. A crusher as claimed in claim 1, further comprising a rotational angle indicator for monitoring a rotational angle between the inner eccentric shaft and the outer eccentric shaft.

* * * * *